US005087401A

United States Patent [19]

Yokoyama et al.

[11] Patent Number: 5,087,401

[45] Date of Patent: Feb. 11, 1992

[54] PROCESS FOR PREPARING POLYESTER FILAMENTARY MATERIAL

[75] Inventors: Tsunenori Yokoyama; Koji Hashimoto; Koichi Sato, all of Mishima, Japan

[73] Assignee: Toray Industries, Inc., Japan

[21] Appl. No.: 440,562

[22] Filed: Nov. 22, 1989

[30] Foreign Application Priority Data

Nov. 24, 1988 [JP] Japan ..... 63-296993

[51] Int. Cl.[5] ..... B29C 47/88; D01D 5/098

[52] U.S. Cl. ..... 264/130; 264/210.4; 264/210.8; 264/211.15; 264/211.17; 264/234; 264/345

[58] Field of Search ..... 264/210.4, 210.8, 211.15, 264/211.17, 211.18, 211.2, 235.6, 235, 342 RR, 130, 345

[56] References Cited

U.S. PATENT DOCUMENTS

| | | | |
|---|---|---|---|
| 3,044,250 | 7/1962 | Hebeler | 264/289.6 |
| 4,049,763 | 9/1977 | Mineo et al. | 264/210.8 |
| 4,456,575 | 6/1984 | Smith et al. | 264/211.17 |

FOREIGN PATENT DOCUMENTS

| | | | |
|---|---|---|---|
| 45-1932 | 3/1967 | Japan . | |
| 55-128011 | 10/1980 | Japan . | |
| 58-91817 | 5/1983 | Japan | 264/211.2 |
| 60-209012 | 10/1985 | Japan | 264/210.8 |
| 62-85020 | 4/1987 | Japan . | |
| 62-263316 | 11/1987 | Japan | 264/210.8 |
| 63-28126 | 6/1988 | Japan . | |

*Primary Examiner*—Jan H. Silbaugh
*Assistant Examiner*—Brian Jones
*Attorney, Agent, or Firm*—Austin R. Miller

[57] ABSTRACT

A process for preparing polyester continuous filamentary material by (a) extruding the polyester material while molten to form filaments, (b) solidifying the molten filaments by cooling them to a temperature at or below their glass transition point, (c) drawing the solidified filaments within a hot drawing zone, (d) subjecting the drawn filaments to a finishing treatment, (e) advancing the finished filaments around first and second godet rollers and, while the filaments are disposed between the first and second godet rollers, subjecting the filaments to heat treatment by advancing the filaments through a heat treatment zone without contacting the filaments with a solid hot surface, the filaments being advanced through the heat treatment zone under a given tension T, and (f) winding the filaments at a speed of at least 4,500 m/min under a given tension t. the respective tensions T and t lie within the ranges $$0.5\,t \leqq T \leqq 0.5 - 0.5\,t \quad \text{(I)}$$

$$0.05 \leqq t \leqq 0.4 \quad \text{(II)},$$

where t means winding tension (g/d) and
T means tension between godet rollers (g/d).

7 Claims, 2 Drawing Sheets

PROCESS FOR PREPARING POLYESTER FILAMENTARY MATERIAL

FIELD OF THE INVENTION

The present invention relates to a process for forming polyester filaments having good qualities and in a uniform package by using only a direct spin draw process, namely, without the need for a separate drawing process.

BACKGROUND OF THE INVENTION

A direct spin draw process is well known as one of the processes for obtaining polyester filaments similar to conventional filaments. Such a direct spin draw process is disclosed, for example, in Japanese Patent Publication No. 1932/1970. This process consists of quenching and solidifying melt-spun polyester filaments to their glass transition temperature or below, advancing the filaments in a heated zone, such as a hot tube, drawing them therein, applying to them an oil and taking them up through godet rollers. However, a defect of this direct spin draw process is that if the spinning speed (take-up speed at the first godet roller) is raised to a level as high as 4,500 m/min or higher to improve the productivity, the spun filaments are taken up in such a way that the strain in the filaments generated on drawing is not sufficiently relaxed and internal strain is therefore released after winding. This internal strain of the filaments causes deformation of the package.

The deformation of the package means, in practice, that both phenomena known as "bulge" and "saddle" become larger. In extreme cases, it is impossible to remove the package because the deformation causes a tightening of the paper tube of the package against its supporting spindle. Bulge is generated by relaxation of the internal strain of the filaments after take-up and the force thereby produced pressing the edge faces of the package. Saddle is generated by tightening of the central part where the hardness is comparatively low caused by the force generated by relaxation of the internal strain. Tightening of the paper tube caused by filament winding occurs when the press-tightening force is extremely large. Further, faults in the package occur during transportation.

As a process for solving the problems associated with the direct spin draw process, Japanese Patent Laid-Open No. 85020/1987 proposes a process wherein separate rollers are provided on each godet roller and the filaments are wound once or more onto these separate rollers and onto the godet rollers so that internal strain in the filaments is thereby relaxed.

Such a process for relaxation serves to extend the take-up time of the filaments between drawing and winding and thereby to relax the internal strain of the filaments. If the take-up time is extended in this manner, improvement of package uniformity can be certainly achieved to some extent, but this process is not always applicable to a wide variety of yarn deniers and the package is easily deformed when the filaments are as thin as 50 denier or thinner or the spinning velocity is 5,000 m/min or higher.

Moreover, when multiple filament yarns are formed in the direct spin draw process, each filament yarn tends to oscillate transversely and the paths of filament yarns become unstable or moving filament yarns interface each other. Such disadvantages as non-uniformity of filament quality and occurrence of yarn breakage thereby occur.

SUMMARY OF THE INVENTION

The purpose of the present invention is to provide a process for forming polyester filaments in a uniform package by means of an improved direct spin draw process using a hot tube.

Another purpose of the present invention is to provide a process for forming polyester filament only the uniform package of which is improved without changing the filament characteristics obtained by the conventional direct spin draw process using a hot tube.

Furthermore, another purpose of the present invention is to provide a process for forming polyester filaments having stable and good processability.

The present invention provides a process for preparing polyester filamentary material comprising (a) extruding the polyester material while molten to form filaments, (b) solidifying the molten filaments by cooling them to a temperature at least as low as their glass transition point, (c) drawing the solidified filaments within a hot drawing zone, (d) subjecting the drawn filaments to a finishing treatment, (e) advancing the finished filaments around first and second godet rollers and, while the filaments are disposed between the first and second godet rollers, subjecting the filaments to a heat treatment by advancing the filaments through a heat treatment zone without contacting the filaments with a solid hot surface, the filaments being advanced through the heat treatment zone under a tension T defined by the following formula (I), and (f) winding the filaments at a speed of at least 4,500 m/min under a tension t defined by the following formula (II), the formulas (I) and (II) being as follow:

$$0.5t \leqq T \leqq 0.5 - 0.5t \quad \text{(I)}$$

$$0.05 \leqq t \leqq 0.4 \quad \text{(II)}$$

t: winding tension (g/d)

T: tension between godet rollers (g/d).

DESCRIPTION OF PREFERRED EMBODIMENTS

Preferred processes embodying the present invention will now be explained in more detail firstly with reference to the accompanying drawing and thereafter with reference to Examples.

Figure 1:
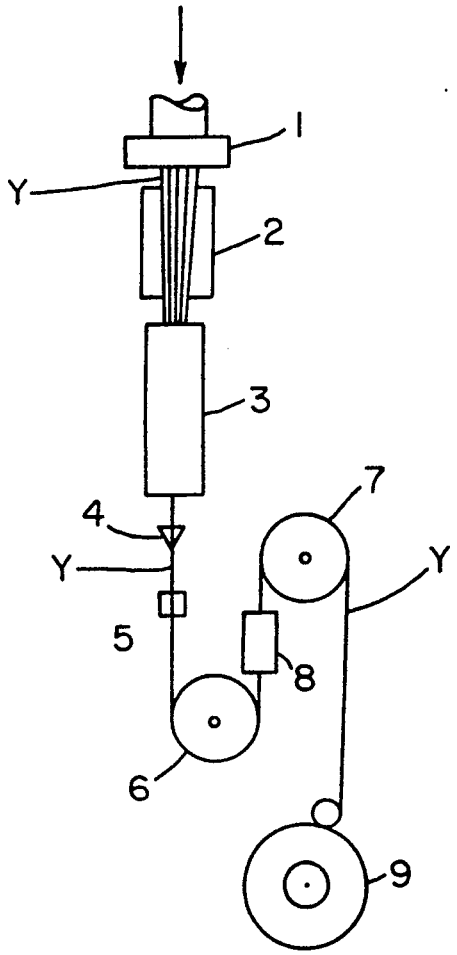
FIG. 1 shows schematically a direct spin-draw system for carrying out a spinning process embodying the present invention.

In FIG. 1, 1 is a spinneret; 2 is a quenching chamber; 3 is a hot tube; 4 is a finishing device; 5 is an interlacing jet; 6 is a first godet roller; 7 is a second godet roller; 8 is a heat treating apparatus; 9 is a winding machine; filaments are shown by the letter Y.

While still in the form of individual separate filaments, polyester filaments Y extruded from the spinneret 1 are immediately cooled down to the glass transition point or below through the quenching chamber 2 and thereafter immediately introduced into a hot drawing zone provided by the hot tube 3, in which the filaments are drawn. After passing through the hot tube 3, the filaments Y are subjected to a finishing treatment in which they are treated with a lubricating agent such as an oil by means of the finishing device 4 and interlacing is carried out by means of the interlacing jet 5. The filaments Y are then passed through a heat treatment zone provided by the heat treating apparatus 8 between the godet rollers 6 and 7 and taken up on a take-up machine 9.

The polyester to which the process of the present invention is applied is usually a polyester having a main repeating unit of ethylene terephthalate, but polyesters having a repeating unit of butylene terephthalate can also be used. Moreover, polyesters wherein one or more other components are copolymerized in an amount of 20% or less and polyesters wherein a small amount of additive is incorporated can also be used.

In a process embodying the present invention, at first a melt-spun polyester is quenched and solidified in the quenching chamber 2 at the glass transition temperature or below so as to carry out a sufficient drawing in the hot tube 3 immediately below the quenching chamber 2.

Thereafter, the quenched and solidified polyester filaments are drawn in the hot tube 3. Temperature and heat treating time in the hot tube 3 eventually influence the rate of shrinkage of the polyester filaments in the same way as in the conventional direct spin draw process. Hence, the heating temperature and the heating time (the length of the hot tube) should be determined in accordance with the desired rate of shrinkage. Usually, a hot tube having a length of 1–2.5 m and a temperature between 120–250° C. is used.

Polyester filaments are drawn in this hot tube. The draw ratio of the direct spin draw process of the invention is represented by the ratio of the velocity of the polyester filaments taken from the hot drawing zone to that of the polyester filaments introduced into the hot drawing zone and the value is usually 1.5–3 times, preferably 1.5–2.5 times. This draw ratio is determined by the take-up velocity, the quenching length, and the length and the temperature of the hot tube. Therefore, the take-up velocity, the quenching length and the draw ratio should be determined in accordance with the desired physical characteristics, especially strength and elongation of the polyester filaments finally desired.

The drawn polyester filaments are thereafter treated with a lubricant such as an oil. The lubricant usually is any of those which are generally used for woven fabrics, knitted fabrics and textured yarns. The amount of lubricant applied is determined by taking into consideration the texturing process and spinnability of the fibers. The amount is usually 0.3–2.0% by weight based on the weight of the filaments.

Three important characteristics of the present invention are that (A) drawn filaments are heat-treated between godet rollers, (B) the tension T of the filaments Y is $0.5t-(0.5-0.5t)$ g/d when the filaments pass through the heat-treatment zone, and (C) the winding tension t is 0.05–0.4 g/d.

Namely, without the heat-treatment zone the internal strain of the filaments generated on drawing in the hot drawing zone is not sufficiently relaxed irrespective of the tension conditions and the saddle and bulge become large. On the other hand, when the tension of the filaments in the heat-treatment zone is not within the specified range, both saddle and bulge are still large or the yarn path between the godet rollers becomes unstable. Moreover, even if the strain is relaxed in the heat-treatment zone, when the winding tension exceeds a certain appropriate value, again both of the saddle and bulge become large.

Furthermore, internal strain of the filaments generally increases with winding velocity on take-up and when the winding velocity becomes 4,500 m/min or larger, especially 5,000 m/min or larger, both bulge and saddle of the package tend to become remarkably large.

In the process of the present invention, a first requirement of the invention is to provide a heat-treatment zone between godet rollers. When the filaments are taken up with a velocity of 4,500 m/min or larger, air flow brought into the heat-treatment zone and heat capacity taken out of the heat-treatment zone along with the filaments are remarkably large and the passage time through the heat-treatment zone is very short, namely 0.01 sec or less. An effective heat treatment is therefore required.

From this point of view, as the means of heat treatment, wet heat such as steam having high heat capacity should be most suitable.

Figure 2:
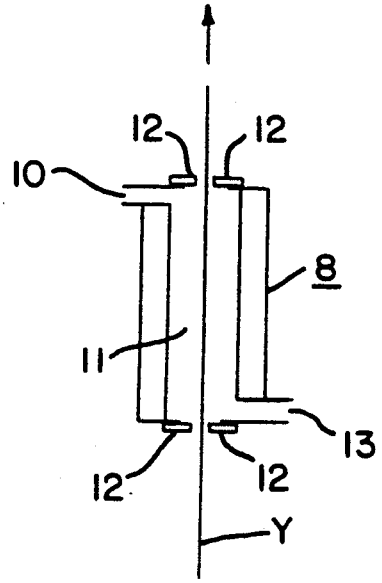
FIG. 2 illustrates in more detail heat treating apparatus present in the spin-draw system of FIG. 1.

One form of heat-treating apparatus 8 using steam is shown into FIG. 2. Steam is introduced in a heat-treating chamber 11 from an inlet 10 and filaments Y pass through the chamber 11 in a steam atmosphere. The upper part and bottom part of the apparatus 8 are sealed with ceramic guides 12. The front face of the apparatus is also sealed with a cover (not shown in the FIGURE). Drainage generated at starting-up time etc. is recovered from a recovery hole 13. In this case, a construction such that steam can fill the whole chamber is preferable. The position of the inlet is not restricted to that shown in FIG. 2.

When dry heat providing a temperature of 300° C. or higher is used as an alternative means of heat treatment, the same effect as that of wet heat (steam) can be obtained. However, when yarn breakage occurs, it is difficult to remove molten polymer which may then adhere to the surface of the chamber. Accordingly wet heat treatment is preferable to dry heat treatment.

On the other hand, if the filaments are brought into contact with a hot plate, the same effect as that of wet heat (steam) can be obtained at about 200° C. However, filaments taken up at 4,500 m/min or higher in contact with the hot plate are broken. So, a non-contact type of heating is therefore needed.

When steam is used, a sufficient effect can be obtained with a length of treatment of 200 mm or longer and a treating temperature of 80° C. or higher, preferably 80–120° C. If the temperature is lower than 80° C., relaxation of internal strain by heat treatment occurs, and both bulge and saddle are large. This is because the internal strain is not sufficiently relaxed as the temperature of the filaments reaches at most 80° C., which is only a little higher than the glass transition point.

On the other hand, if the temperature exceeds 120° C., the size of the apparatus needs to be larger in order to maintain the steam under seal and thus maintain it under pressure, and problems tend to occur from the point of view of maintenance. It is therefore preferable that the upper limit of the temperature is about 120° C.

Relaxation effect of strain is also influenced by the heat-treating time. A sufficient effect can be obtained if the heat-treating time is 0.001 sec or longer, preferably 0.002–0.01 sec. If the heat-treating time is shorter than 0.001 sec, the passage time through the heat-treating apparatus is too short and a higher temperature is therefore needed to obtain a sufficient heat-treating effect. Correspondingly such problems as sealing of the steam at a super-atmospheric pressure as described above occur and this is not desirable. On the other hand, to allow a longer heat-treating time of 0.01 sec or longer, a large heat-treating apparatus of 75 cm or longer is needed and therefore, the whole apparatus becomes large and the operability correspondingly becomes more difficult and these tendencies are not preferred. Moreover, the higher the take-up speed of the filaments, the greater the length of the heat-treating apparatus required to obtain the same level of heat-treating effect.

Next, a second requirement of the present invention concerns the tension of the filaments passing through the heat-treating apparatus. The tension T of the filaments passing through the heat-treating apparatus 8 should be 0.5t -(0.5−0.5t) g/d in relation to the winding tension t. If the tension T of the filaments passing through the heat-treating apparatus is lower than 0.5 times that of the winding tension t, yarns contact each other in the heat-treating apparatus and on the second godet roller, and this leads to yarn breakage. On the other hand, if the tension T of the filaments passing through the heat-treating apparatus is larger than (0.5−0.5t) g/d in relation to the winding tension t, relaxation of the internal strain is not sufficient and both saddle and bulge become large.

Therefore, it is necessary that the internal strain of the filaments is relaxed under a tension close to the winding tension. When the tension at heat treatment is remarkably higher than the winding tension, the filaments are taken up while strain remains and upon relaxation after winding saddle and bulge become large. From this point of view, the tension T of the filaments after passing through the heat treating apparatus is preferably 0.4 g/d or smaller.

A third requirement of the present invention concerns the level of the winding tension itself and it is required that the winding tension be 0.4 g/d or smaller. Namely, even if the heat treatment is carried out at a tension of the filaments close to the winding tension, when the winding tension is 0.4 g/d or larger, saddle and bulge are large as the strain itself is large. Preferably, the winding tension is 0.3 g/d or smaller in which case the effect of the present invention becomes even more remarkable.

On the other hand, it is necessary that the winding tension is 0.05 g/d or larger to perform stable winding.

Moreover, it is necessary that the winding velocity of the filaments is 4,500 m/min or higher, preferably 4,500 -6,000 m/min, more preferably 4,500–5,500 m/min.

A first advantage provided by the process of the present invention is the capability of obtaining a uniform package form. No faults in the package during transportation and no trouble on unwinding at the user side occur because the package form is uniform.

A second advantage of the process of the present invention is that the heat treatment between godet rollers improves the package uniformity without changing any characteristics of the filaments which may remain the same as those obtained by a conventional direct spin draw process. Namely, no change in the most important characteristics of the filaments such as dyeability occurs regardless of the use of this heat treatment. As a result, especially when establishing a multiple spinning machine, production management becomes extremely easy.

A third advantage of the process of the present invention is that filament oscillation on or between godet rollers is small for multiple yarns and operational capability is therefore good.

As in the conventional process shown in Japanese Patent Laid-Open No. 85020/1987 where filament yarns are wound on godet rollers a number of times by utilizing a separate roller, especially, where multiple yarns (e.g., eight yarns) are simultaneously wound moving filaments oscillate transversely and their paths become unstable and filament breakages often occur as a result. On the contrary, as it is not necessary in the process of the present invention to wind filaments around godet rollers using a separate roller, then even if multiple yarns are moved simultaneously, oscillation of each yarn is small, the stability of their paths is excellent and the operational capability is good.

Examples of processes embodying the invention are given below.

Here, judgment of the quality of the package form is based on the standard described below.

| | | Bulge | | |
|---|---|---|---|---|
| | | 10 mm or below | 10 mm–15 mm | above 15 mm |
| Saddle | 1.5 mm or below | ◎ | ∘ | Δ |
| | 1.5 mm–2.5 mm | ∘ | Δ | x |
| | above 2.5 mm | Δ | x | x |

Notice:
◎ represents excellent, ∘ represents good, Δ represents acceptable, and x represents bad.

Winding tension and tension between godet rollers are measured by means of the "Tension Checker Type CB" manufactured by Kanai Koki Co., Ltd.

EXAMPLES 1-6 AND COMPARATIVE EXAMPLES 1-6

Polyethylene terephthalate was melted at 290° C. and extruded at an output of 26.7 g/min from a spinneret having 24 holes.

The extruded filaments were cooled down below the glass transition point by passing them through a cross-flow of quenching air flowing at a rate of 20 m/min at 20° C., and were introduced into a hot tube having a total length of 1.3 m placed at 1.6 m below the spinneret. A lubricant was then applied to the filaments, which were then subjected to an interlacing treatment before passing to a first godet roller running at a velocity of 5,000 m/min. The filaments were then fed through a heat treating apparatus to a second godet roller and thereafter wound up on a winding machine to obtain a filament yarn of 50 denier/24 filaments. A steam treating apparatus having a length of 300 mm was used as the heat treating apparatus between the godet rollers and steam was fed into the apparatus to keep the temperature at 98° C. The tension (T) of the filament yarn passing through the steam treating apparatus was variously changed as shown in Table 1 by changing the velocity of the second godet roller and the winding tension (t) was changed, again as shown in Table 1, by changing the winding velocity.

The package width was 114 mm, the wound weight was 5 kg and the quality of the package form was judged by measuring its saddle and bulge.

TABLE 1

| Run No. | | T (g/d) | t (g/d) | T (claimed range of the present invention) | Package form Bulge (mm) | Package form Saddle (mm) | Judge-ment[3] |
|---|---|---|---|---|---|---|---|
| 1 | Comparative Example 1 | 0.08 | 0.2 | 0.1–0.4 | filament breakage occurred | | — |
| 2 | Example 1 | 0.10 | 0.2 | 0.1–0.4 | 6.0 | 1.0 | ◎ |
| 3 | Example 2[4] | 0.20 | 0.2 | 0.1–0.4 | 7.0 | 1.5 | ◎ |
| 4 | Example 3 | 0.30 | 0.2 | 0.1–0.4 | 8.5 | 1.5 | ◎ |
| 5 | Example 4 | 0.40 | 0.2 | 0.1–0.4 | 11.0 | 1.5 | ∘ |
| 6 | Comparative Example 2 | 0.45 | 0.2 | 0.1–0.4 | 13.0 | 2.0 | x |
| 7 | Example 5 | 0.30 | 0.3 | 0.15–0.35 | 10.0 | 1.5 | ∘ |
| 8 | Comparative Example 3 | 0.40 | 0.3 | 0.15–0.35 | 12.5 | 2.0 | x |
| 9 | Example 6 | 0.25 | 0.4 | 0.2–0.3 | 11.0 | 2.5 | Δ |
| 10 | Comparative Example 4 | 0.25 | 0.45 | 0.23–0.28 | 12.5 | 3.0 | x |
| 11 | Comparative Example 5[1] | 0.20 | 0.2 | 0.1–0.4 | package was not removable from wining machine | | — |
| 12 | Comparative Example 6[2] | 0.20 | 0.2 | 0.1–0.4 | 18.0 | 2.0 | x |

Notes:
[1]Comparative Example 5 (Run No. 11) Without heat treatment between godet rollers
[2]Comparative Example 6 (Run No. 12) A separate roller was sent on each of the first and second godet rollers. Without heat treatment between godet rollers.
[3]Judgement of package form ◎ represents excellent, ∘ represents good, Δ represents acceptable, and x represents bad.
[4]Best method.

Run Nos. 1, 6, 8, 10, 11 and 12 were Comparative Examples to illustrate the disadvantages of processes outside the present invention and thereby show even more clearly the advantageous effects of the processes embodying the present invention.

Figure 3:
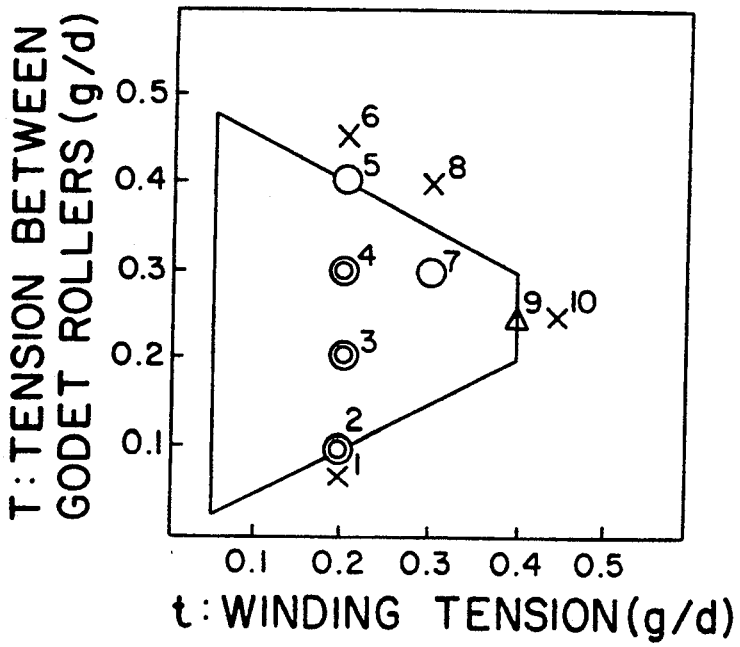
FIG. 3 is a graph showing a relationship between winding tension t and tension between godet rollers T.

As clearly indicated in Table 1 and FIG. 3, in Run Nos. 1, 6 and 8 the tension T in the heat treating apparatus lay outside the range required for a process of the invention. In Run No. 1, T was too low and this resulted in large filament oscillation and an unstable filament path. In Runs Nos. 6 and 8, T was too high and both saddle and bulge were large.

Moreover, in Run No. 10 where the winding tension t was outside the range required for a process of the present invention both saddle and bulge were large, while in Run No. 11 where no heat treatment was performed between the godet rollers it was impossible to remove the package as a result of the tightening of the paper tube on which the package was wound against its supporting spindle.

On the other hand, in each of Runs Nos. 2, 3, 4, 5, 7 and 9 where the conditions were within the ranges required by the present invention, both saddle and bulge were small and no difficulties occurred during operation.

In Run No. 12, based on the process shown in Japanese Patent Laid-Open No. 85020/1987, a separate roller was set on each of the first godet roller and the second godet roller. The filament yarn was wound once onto the first godet roller and its separate roller and twice onto the second godet roller and its separate roller and no heat treatment was performed. In this Example, both bulge and saddle were remarkably larger than those encountered when using the processes embodying the present invention.

The results indicated that even if the yarn path was enlarged and the time before winding was correspondingly extended, strain generated during drawing was not sufficiently released.

EXAMPLES 7–12 AND COMPARATIVE EXAMPLE 7

The same spinning conditions as those described in Example 1 were employed for spinning and each package of a 5 kg winding was prepared for each of different heat treating conditions, namely, wet heat (steam), a non-contacting heater providing dry heat and a contacting type hot plate as the heat treating apparatus. Thus the winding speed was 5,000 m/min so as provide a winding tension t of 0.2 g/d, the tension T of the filament yarn introduced into the heat treating apparatus was set at 0.2 g/d, and both the non-contacting heater providing dry heat and the contacting type hot plate had a length of 500 mm.

TABLE 2

| Run No. | | Heat treating apparatus[1] | Temperature (°C.) | Package form Saddle (mm) | Package form Bulge (mm) | Package form Judgement | Broken filament | Final[2] Judgement |
|---|---|---|---|---|---|---|---|---|
| 13 | Example 7 | A | 80 | 10.5 | 2.5 | Δ | ∘ | Δ |
| 14 | Example 8 | A | 89 | 9.5 | 2.0 | ∘ | ∘ | ∘ |
| 15 | Example 9[3] | A | 98 | 7.0 | 1.5 | ◎ | ∘ | ∘ |
| 16 | Example 10 | A | 105 | 7.0 | 1.5 | ◎ | ∘ | ∘ |
| 17 | Example 11 | A | 116 | 7.0 | 1.0 | ◎ | ∘ | ∘ |
| 18 | Example 12 | B | 300 | 12.0 | 2.0 | Δ | ∘ | Δ |
| 19 | Comparative | C | 200 | 11.5 | 2.0 | Δ | x | x |

TABLE 2-continued

| Run No. | Heat treating apparatus(1) | Temperature (°C.) | Package form Saddle (mm) | Bulge (mm) | Judgement | Broken filament | Final(2) Judgement |
|---|---|---|---|---|---|---|---|
| Example 7 | | | | | | | |

Notes:
(1)Heat treating apparatus A, B anc C represent a wet heat (steam) heater, a non-contacting heater provided dry heat and a contacting type hot plate respectively.
(2)Final judgement ∘ represents good, Δ represents acceptable, and x represents bad.
(3)Best method.

Run No. 19 was a Comparative Example to illustrate the disadvantages of using a heater unsuitable for use in the process of the invention and thereby show even more clearly the advantageous effects of the process embodying the present invention.

As clearly indicated in Table 2, in Run No. 19 where a contacting type hot plate was used, the package form was moderate, but some filaments were broken on the end face of the package and as a result, the quality of the product was bad.

On the contrary, in Run Nos. 13–17 wherein the effects of the heat treatment were sufficient, then in each case the internal strain was sufficiently relaxed and the saddle and bulge were small. Moreover, in Run No. 18 wherein a dry heat type heating apparatus at 300° C. was used, an improved package form having about the same improved characteristics as produced by wet heat (steam) was obtained, but the wet heat process was preferable as the heat treating means when taking into consideration the fact that when using a dry heat, a cleaning operation of the heat treating apparatus may be required should any filament breakage occur. This is because such breakage tends to leave molten polymer on the inner surface of the heat treating apparatus.

We claim:

1. A process for preparing polyester filamentary material comprising (a) extruding the polyester material while molten to form molten filaments, (b) solidifying the molten filaments by cooling them to a temperature at least as low as their glass transition point, (c) drawing the solidified continuous filaments within a hot drawing zone, (d) subjecting the drawn continuous filaments to a finishing treatment, (e) advancing the finished continuous filaments around first and second godet rollers and, while the continuous filaments are disposed between the first and second godet rollers, subjecting the continuous filaments to heat treatment by advancing them through a heat treatment zone without contacting them with a solid hot surface, the continuous filaments being advanced through the heat treatment zone under a tension T defined by the following formula (I), and (f) winding the continuous filaments at a speed of at least 4,500 m/min under a tension t defined in the following formula (II), namely wherein $$0.5t \leqq T \leqq 0.5-0.5t, \text{ and wherein} \quad (I)$$

$$0.05 \leqq t \leqq 0.4, \quad (II)$$

wherein t means winding tension (g/d) and where

T means tension between godet rollers (g/d).

2. A process according to claim 1, wherein steam is used as a means of heat treatment between the godet rollers.

3. A process according to claim 1, wherein the heat treatment between godet rollers is carried out at a treating temperature of 80° C. or higher.

4. A process according to claim 1, wherein the winding speed is in a range between 4,500 m/min and 6,000 m/min inclusive.

5. A process according to claim 1, wherein the winding speed is in a range between 4,500 m/min and 5,500 m/min inclusive.

6. A process according to claim 1, wherein the continuous filaments are caused to pass through the heat treatment step for at least 0.001 sec.

7. A process according to claim 1, wherein the finishing treatment(d) comprises applying a lubricant to the continuous filaments.

* * * * *

UNITED STATES PATENT AND TRADEMARK OFFICE

CERTIFICATE OF CORRECTION

PATENT NO. : 5,087,401

DATED : February 11, 1992

INVENTOR(S) : Tsunenori Yokoyama et al

It is certified that error appears in the above-identified patent and that said Letters Patent is hereby corrected as shown below:

On the Title page, at item [22], please change "440,562" to --440,592--.

Signed and Sealed this

Eighth Day of June, 1993

*Attest:*

Michael K. Kirk

MICHAEL K. KIRK

*Attesting Officer*

*Acting Commissioner of Patents and Trademarks*

UNITED STATES PATENT AND TRADEMARK OFFICE

CERTIFICATE OF CORRECTION

PATENT NO. : 5,087,401

DATED : February 11, 1992

INVENTOR(S) : Tsunenori Yokoyama et al

It is certified that error appears in the above-identified patent and that said Letters Patent is hereby corrected as shown below:

On the title page, at item [21], please change "440,562" to --440,592--.

This certificate supersedes Certificate of Correction issued June 8, 1993.

Signed and Sealed this

Twenty-second Day of February, 1994

*Attest:*

Bruce Lehman

BRUCE LEHMAN

*Attesting Officer*

*Commissioner of Patents and Trademarks*